US005398360A

United States Patent [19]

Alexander

[11] Patent Number: 5,398,360

[45] Date of Patent: Mar. 21, 1995

[54] SURVIVAL TOOL

[76] Inventor: Hugh E. Alexander, 18140 W. Avenue D, Lancaster, Calif. 93536

[21] Appl. No.: 140,867

[22] Filed: Oct. 25, 1993

[51] Int. Cl.[6] ..... B26B 11/00

[52] U.S. Cl. ..... 7/158; 7/144; 30/143; 30/351

[58] Field of Search ..... 7/106, 143, 144, 158, 7/165, 166; 30/123, 143, 346, 351, 356, 357

[56] References Cited

U.S. PATENT DOCUMENTS

| | | | |
|---|---|---|---|
| 4,363,147 | 12/1982 | Deweese | 7/158 |
| 4,442,559 | 4/1984 | Collins | 7/158 |
| 4,669,140 | 6/1987 | Miceli | 7/158 |
| 4,817,221 | 4/1989 | Ryan | 7/158 X |

*Primary Examiner*—James G. Smith

[57] ABSTRACT

An improved survival tool comprising a large knife having double-edged recurved blade with a chisel tip and ergonomically-designed hilt and full tang and having a pair of ergonomically-designed releasably attachable scales covering the hilt and tang forming the finger guards/grips and handle of said tool, said blade being formed with a sharpened edge extending along one entire side of said recurved blade and having a false edge on the opposite side of said blade extending rearwardly from said chisel tip to a flattened portion at the belly of said blade which serves as a hammer-anvil or palm rest and having a serrated or saw-toothed concave section extending rearwardly from said flat portion of said blade to said hilt and having an elongated opening formed axially of said blade to allow insertion of a plurality of fingers to form a hand-hold, or function as a spanner or tool holder, and an opening to 1) releasably attach said tool to a sheath having a friction-fit pin that is part of said sheath, and 2) to accept a cross guard for conversion of said tool to a trident-lance by detaching said scales and releasably attaching a shaft having a bifurcated end to the said full tang.

9 Claims, 6 Drawing Sheets

SURVIVAL TOOL

BACKGROUND

1. Field of Invention

This invention relates to hand tools and is particularly directed to multipurpose hand tools for use in survival situations and in hostile environments, such as underwater or in outer space.

2. Prior Art

A survival situation is one in which a person finds themselves with minimal equipment and supplies, at best, and where their continued existance depends upon making the most of what they have. Clearly then, a survival tool must be a multi-purpose device which serves a plurality of functions easily and efficiently and which can be converted from one function to another with minimal time and effort. Thus, a survival tool is often required to serve as a weapon for hunting or protection, as an axe for cutting wood for fires or shelter, and as a tool for repairing or modifying other equipment. Unfortunately, performance of these various functions often require modification or alteration of the survival tool and may lead to considerable complication in the structure of the tool. Thus, many prior art survival tools are highly specialized and, hence, are extremely limited in utility. Other prior art survival tools are overly complex in construction, becoming merely complicated toys which are of little value in real survival conditions, or requiring so much time or effort to convert from one function to another that they are of little, if any, real value. Still other prior art survival tools are so designed that they are more danger than help to the user. Again, some prior art survival tools are difficult to transport from place to place and, hence, may be unavailable when most needed. A search in the United States Patent Office has revealed the following:

| U.S. PAT. NO. | INVENTOR | ISSUED |
|---|---|---|
| 4,622,707 | C. A. Finn | Nov. 18, 1986 |
| 4,803,745 | A. Izquierdo | Feb. 14, 1989 |
| 4,817,221 | W. W. Ryan | Apr. 4, 1989 |
| 4,821,356 | C. A. Finn | Apr. 18, 1989 |

Each of these references is subject to the limitations discussed above. Thus none of the prior art survival tools have been entirely satisfactory. As a result, members of SEAL Team One of the United States Navy Special Warfare Command requested the present inventor, who is an ex-UDT SEAL Master-At-Arms to design a survival tool which would be superior to those of the prior art.

BRIEF SUMMARY AND OBJECTS OF INVENTION

These disadvantages of the prior art are overcome with the present invention and improved survival tool is provided which is simple in construction, is capable of performing a wide variety of functions with little or no conversion or modification, and, when necessary or desirable, can be converted quickly and easily to perform and additional plurality of functions. Furthermore, the survival tool of the present invention is extremely easy to transport and can be available instantly when needed.

The advantages of the present invention are preferably attained by providing an improved survival tool comprising a large knife having a double-edged recurved blade with a chisel tip at one end of said blade and ergonomically-designed hilt and full tang at the opposite end of said blade. A pair of ergonomically designed scales covering the hilt and tang are releasably attachable to said hilt and tang to form the finger guards/grips and handle of said tool. A sharpened edge extends along one entire side of said recurred blade from said hilt to said chisel tip. The opposite edge of said recurred blade is formed with a false edge extending rearwardly from said chisel tip to a flattened portion at the belly of said blade that serves as a hammer-anvil or palm rest. The concave section of said blade that extends rearwardly from said flat portion of said blade is serrated or saw toothed to said hilt with an elongated opening formed axially to said blade to allow insertion of a plurality of fingers to form a hand-hold, or function as a spanner or tool holder. Said hilt is formed with an opening to releasably attach said tool to a sheath with a friction-fit pin that is part of said sheath. Said sheath is designed to hold said tool and provide quick access to the use of said tool by said sheath's skeletonized design and friction-fit pin. Said sheath is releasably attachable to a belt shoulder harness or other load-bearing gear by suitable means such as a strap with hook-and-loop material that is secured to the back of said sheath. Said tool is easily converted to a trident-lance by installing a cross guard through said threaded hole formed in said hilt and releasably attaching a shaft with a bifurcated end to the said full tang in place of said handle scales.

Accordingly, it is an object of the present invention to provide and improved survival tool.

Another object of the present invention is to provide an improved survival tool which is simple in construction, yet is capable of performing a wide variety of functions with little or no conversion or modification.

An additional object of the present invention is to provide an improved survival tool which, when necessary or desirable, can be converted quickly and easily to perform an additional plurality of functions.

A further object of the present invention is to provide an improved survival tool which is extremely easy to transport and can be available instantly when needed.

A specific object of the present invention is to provide an improved survival tool comprising a large knife having a double-edged recurved blade with a chisel tip at one end of said blade and ergonomically-designed hilt and full tang at the opposite end of said blade and having a pair of ergonomically designed scales covering the hilt and tang which are releasably attachable to said hilt and tang, forming the finger guards/grips and handle of said tool, said blade being formed with a sharpened edge extending along one entire side of said recurred blade from said hilt to said chisel tip and having a false edge on the opposite side of said blade extending rearwardly from said chisel tip to a flattened portion at the belly of said blade which serves as a hammer-anvil or palm rest and having a serrated or saw-toothed concave section extending rearwardly from said flat portion of said blade to said hilt and having an elongated opening formed axially of said blade to allow insertion of a plurality of fingers to form a hand-hold, or function as a spanner or tool holder, and with said hilt formed with an opening to 1) releasably attach said tool to a sheath having a friction-fit pin that is part of said sheath, said sheath being designed to hold said tool and provide quick access to the use of said tool by said sheath's skeletonized design and friction-fit pin and with said sheath being releasably attachable to a belt shoulder harness or other load-bearing gear by suitable means such as a strap with hook-and-loop material secured to the back of said sheath and 2) to accept a cross guard for conversion of said tool to a trident-lance by detaching said scales and releasably attaching a shaft having a bifurcated end to the said full tang.

These and other objects and features of the present invention will be apparent from the following detailed description, taken with reference to the figures of the accompanying drawing.

DETAILED DESCRIPTION OF THE INVENTION

Figure 1:
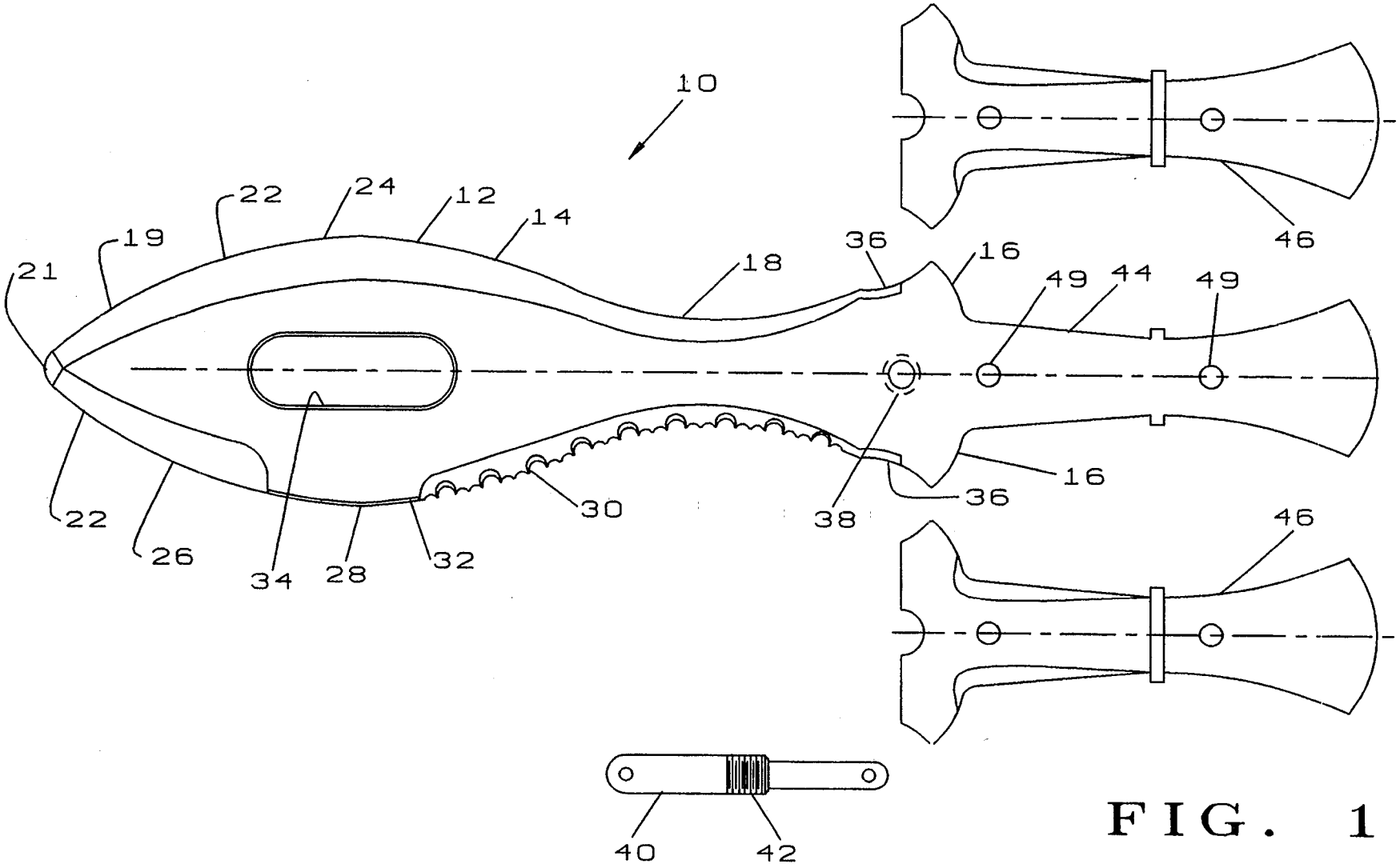
FIG. 1 is an exploded side view of a survival tool embodying the present invention.
Figure 2:
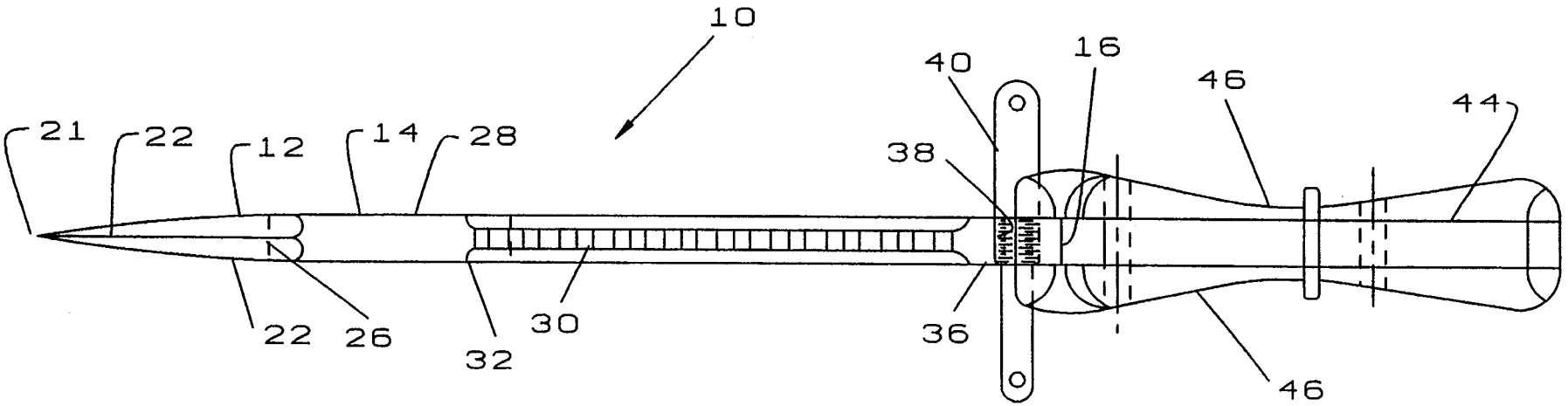
FIG. 2 is an edge view of the survival tool of FIG. 1, showing the flattened hammer portion.
Figure 3:
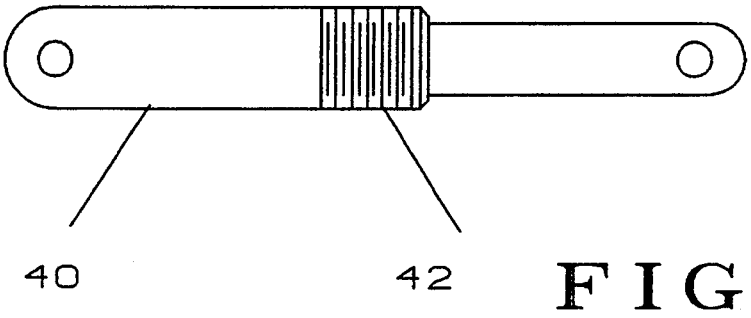
FIG. 3 is a side view of a cross guard for releasable attachment to the survival tool of FIG. 1.
Figure 4:
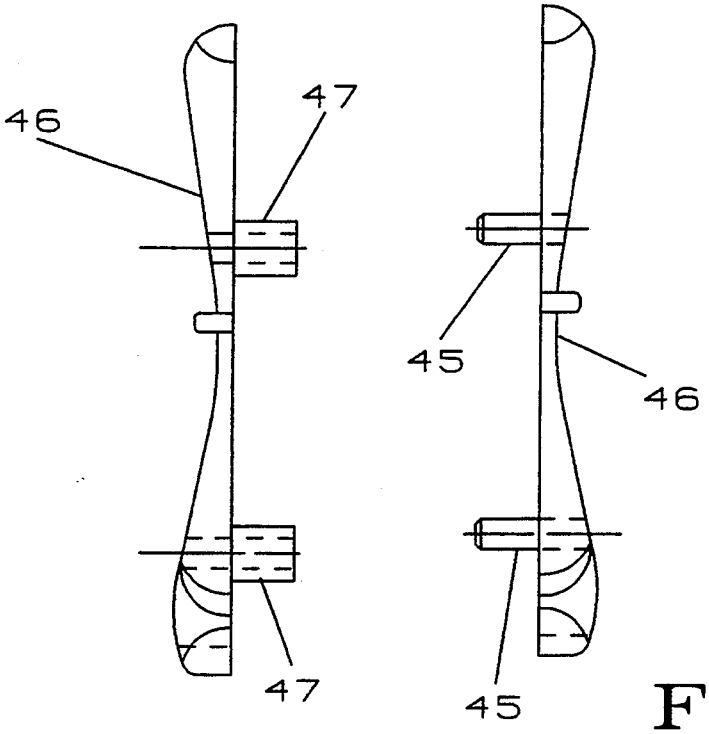
FIG. 4 is a side view of a cross guard for releasable attachment to the survival tool of FIG. 1.
Figure 5:
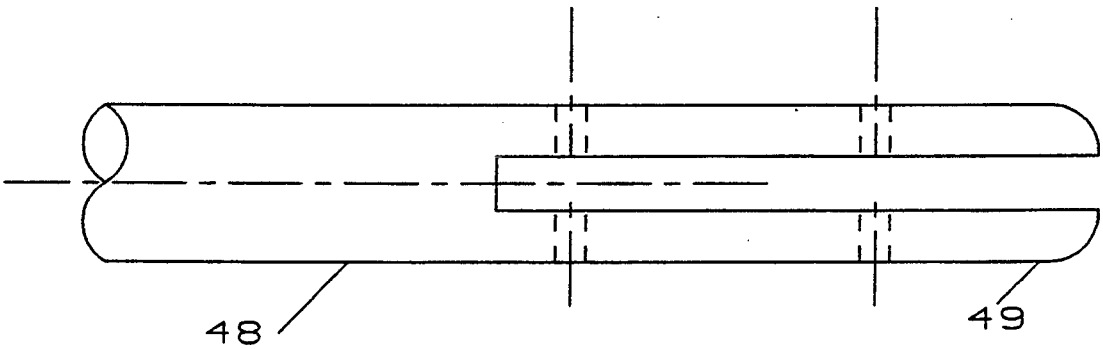
FIG. 5 is a side view of a shaft for releasable attachment to the survival tool of FIG. 1.
Figure 6:
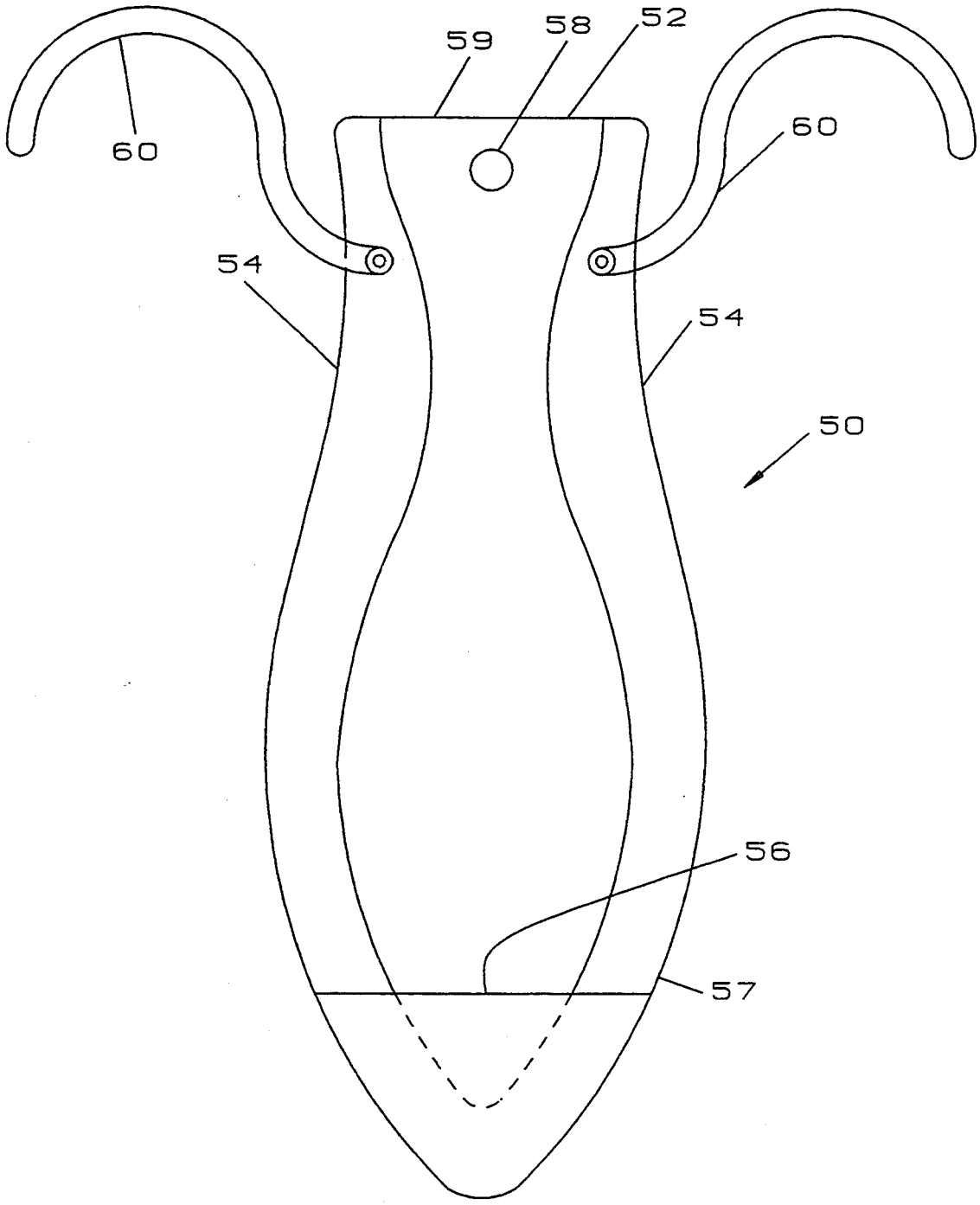
FIG. 6 is a front view of a sheath for the survival tool of FIG. 1.

In that form of the present invention chosen for purposes of illustration in the drawing, FIG. 1 shows a survival tool, indicated generally at 10 comprising a knife 12 having a blade 14 having a hilt 36 located adjacent one end 18 of the blade 14 and having a chisel tip 21 (which can also serve as wedge, screw driver or the like) at the other end 19 of the blade 14. The blade 14 is formed with a cutting edge 22 extending along one entire side 24 of the blade 14 to the tip 21 and rearwardly along the opposite side 26 of the blade 14 for a short distance. Rearwardly of the cutting edge 22 a flattened portion 28, of approximately ¼-inch thickness, which serves as a hammer, anvil or palm rest and extends along side 26 of the blade 14 with a serrated portion 30 continuing concavely from the rear end 32 of flattened portion 28 to the hilt 36. An elongated opening 34 is formed in the blade 14 and extends approximately 3 inches axially of the blade 14 a sufficient distance to allow insertion of four of the user's fingers. The hilt 36 has a pair of curved quillons 16, projecting forwardly and communicating with the sides 24 and 26 of the blade 14 to serve as finger guards or grips for better control of the tool. Also, the hilt 36 has an internally threaded opening 38 for releasably receiving a cross guard 40 to convert the tool 10 into a trident. The cross guard 40 is a generally cylindrical member having a central external thread 42 which is mateable with the internal threads of the opening 38 of the hilt 36. Finally, the hilt 36 has a full tang 44 which extends rearwardly from the hilt 36. A pair of ergonomically-designed scales 46 are releasably attachable to each side of the full tang 44 and quillons 16 by suitable means, such as frictionally engageable male and female fittings 45 and 47, respectably, which are insertable through suitable openings 49 in the full tang 44, and a shaft 48 is interchangeable with the scales 46 to convert the tool 10 into a lance. The shaft 48 has a bifurcated forward portion 49 which corresponds to the scales 46 to releasably attach the shaft 48 to the full tang 44 of the survival tool 10.

Figure 7:
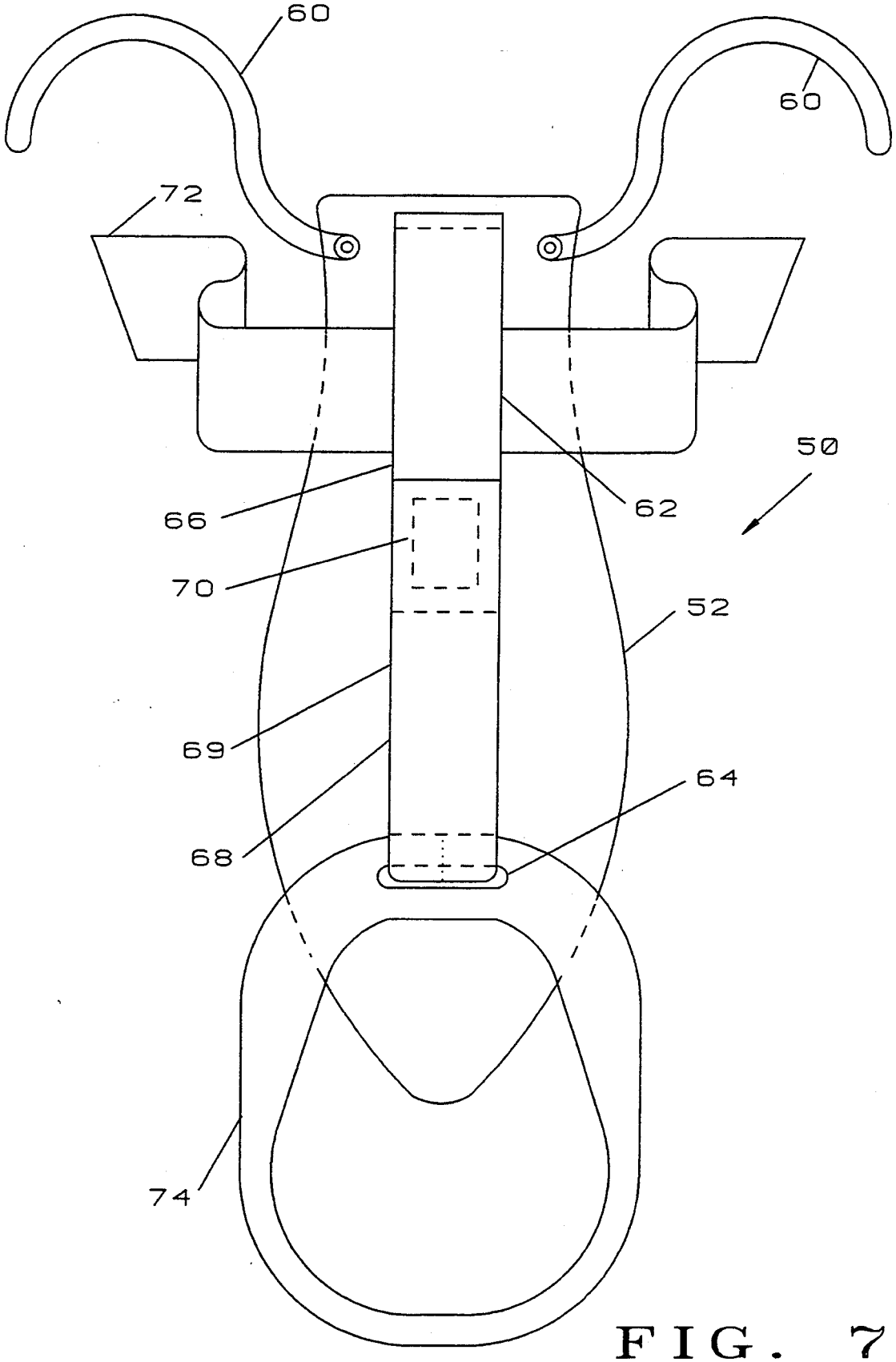
FIG. 7 is a rear view of the sheath of FIG. 6.
Figure 8:
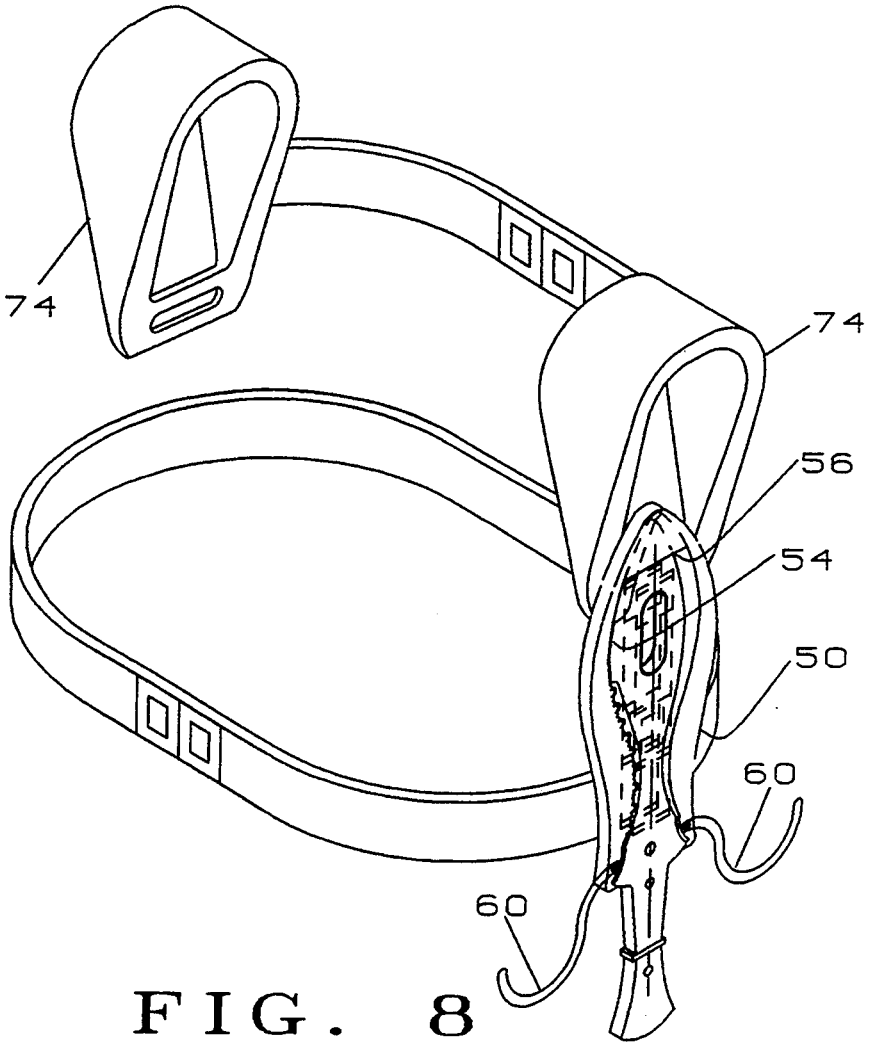
FIG. 8 is a diagrammatic representation showing the sheath of FIG. 6 supporting the survival tool of FIG. 1 from a user's shoulder.
Figure 9:
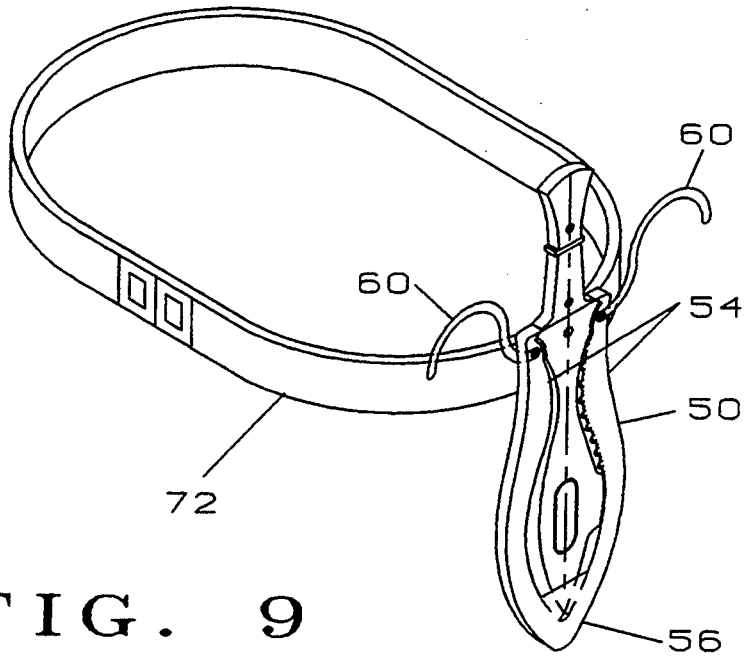
FIG. 9 is a diagrammatic representation showing the sheath of FIG. 6 suspending the survival tool of FIG. 1 from a user's belt.

For carrying the survival tool 10, a sheath 50 is provided, as seen in FIGS. 6–9 and is formed with a flat plate 52 conforming generally to the outline of the blade 14, but slightly larger, and having a pair of raised side members 54 extending along each side of the plate 52 to prevent inadvertent contact with the blade 14 and to retain the blade 14 on the plate 52. A toe plate 56 extends across the lower end 57 of the side members 54 to retain end 19 of the blade 14, and a pin 58 projects from the plate 52 adjacent the upper edge 59 of the plate 52 for frictional engagement with opening 38 of the hilt 36 to releasably secure the survival tool 10 to the sheath 50. Preferably, straps 60 are provided adjacent the upper end of each of the side members 54 to allow the survival tool 10 to be tied into the sheath 50, when desired. As best seen in FIG. 7, a strap 62 has a base portion 69 which extends substantially the full length of the plate 52 and has flap portions 66 and 68 which overlie the base portion 69 and are releasably secured together by suitable means, such as tabs 70 of hook-and-loop material. A belt 72 may be passed between the base portion 69 and flap 66 of the strap 62 to releasably suspend the sheath 50 from the user's waist, as seen in FIG. 9. Alternatively, flap 68 of strap 62 may be passed through slotted hole 64 in shoulder strap 74 and releasably secured by suitable means such as hook-and-loop 70 to base 69 as shown in FIGS. 7 and 8.

In use, the user can carry the survival tool 10 in the sheath 50, either on a shoulder strap 74, as seen in FIG. 8, or on a belt 72, as seen in FIG. 9. Either way, the survival tool 10 can be carried comfortably and easily, yet is immediately available for use, when needed. If the user anticipates needing to use the survival tool 10, they may untie the straps 60, so that the survival tool 10 is retained in the sheath 50 simply by the frictional engagement of pin 58 with opening 38 of the hilt 36 of tool 10. Thus, the user can remove the tool 10 from the sheath 50 by simply grasping the full tang 44 and pulling it outward to disengage opening 38 from the pin 58 and to remove end 19 of the blade 14 from the toe plate 56 of the sheath 50, leaving the survival tool 10 free for use. Once removed from the sheath 50, the survival tool 10 can perform a wide variety of functions. With the scales 46 attached to the full tang 44 and quillons 16, the user can comfortably grasp the handle portion 44 and quillons 16 in one hand for comfortable and balanced control of the tool. The long cutting edge 22, extending along side 24 of the blade 14 is ideal for chopping, slitting or slicing, while the short portion of cutting edge 22, extending along side 26 of the blade 14 adjacent end 19, facilitates stabbing. The saw-toothed portion 30 allows the survival tool 10 to function as a saw and opening 34 allows the user to grasp the full tang 44 of the survival tool 10 with one hand and to insert four fingers of the other hand through opening 34 to provide a better grip for the sawing action. Also, by gripping the survival tool 10 in this manner and pulling, side 26 of the blade 14, can be used as a draw knife for lengthwise splitting, shaving or peeling of branches and the like. Also, opening 34 can facilitate use of the survival tool 10 as a spanner or tool holder. Obviously, the flattened portion 28 is intended for use as a hammer, anvil or palm rest. Moreover, by removing the scales 46 and attaching the shaft 48, the survival tool 10 can function as a spear, lance or paddle. If necessary or desirable, the cross guard 40 can be threaded into opening 38 of the hilt 36 to convert the survival tool 10 into a true trident. This is of particular importance for defending against creatures, such as Moray eels, which will continue to attack, even when the blade is thrust into their mouth. The cross guard 40, thus, provides a safety barrier which prevents further advance of the creature toward the user. The cross guard 40 can also serve to allow the survival tool 10 to be used as an anchor, boat hook or the like. Because the scales 46 and shaft 48 are interchangeable and are both releasably attached to the full tang 44 of the tool 10, the survival tool 10 can be converted, quickly and easily, from one use to another.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A survival tool comprising:

a blade with a hilt at one end and a chisel tip at another end, an opening in said blade extending axially along said blade to allow insertion of a plurality of fingers, a tang attached to said blade at the hilt, said hilt having a second opening, a cross guard attachable to said second opening to convert said tool to a trident, said hilt also having a pair of quillons projecting outwardly therefrom, said blade formed with a first cutting edge on one side therefore that extends the full length of said blade and a second cutting edge on another side of smaller length, a flattened portion formed on said other side of said blade adjacent said second cutting edge, a serrated portion adjacent said flattened portion and extending to said hilt, and a pair of scales releasably attached to said tang.

2. The survival tool of claim 1 further comprising: the thickness of said blade at said flattened portion is approximately $\frac{1}{4}$ inch.

3. The survival tool of claim 1 further comprising: the length of said opening is sufficient to receive four fingers of a user's hand.

4. The survival tool of claim 1 further comprising: the length of said elongated opening is approximately 3 inches.

5. The tool of claim 1 wherein: said opening is formed for use as a spanner.

6. The survival tool of claim 1 further comprising: a shaft releasably attachable to said tang.

7. The survival tool of claim 1 further comprising: a sheath having a retaining receivable in said second open pin for releasably attaching said tool to said sheath.

8. The survival tool of claim 7 further comprising: said sheath having a strap attachable to said sheath for suspending said sheath from a shoulder harness.

9. The survival tool of claim 7 further comprising: said sheath having means for releasably attaching said sheath to a user's belt.

* * * * *